United States Patent [19]

Cash

[11] 4,001,025

[45] Jan. 4, 1977

[54] PROCESS OF SENSITIZING SILVER HALIDE EMULSIONS WITH HETEROCYCLIC SULFUR COMPOUNDS

[75] Inventor: Derek J. Cash, Harlow, England

[73] Assignee: Minnesota Mining and Manufacturing Company, St. Paul, Minn.

[22] Filed: Oct. 10, 1974

[21] Appl. No.: 513,492

[52] U.S. Cl. ..... 96/107

[51] Int. Cl.[2] ..... G03C 1/28

[58] Field of Search ..... 96/107

[56] References Cited

UNITED STATES PATENTS

| | | | |
|---|---|---|---|
| 2,410,689 | 11/1946 | Sheppard et al. | 96/107 |
| 3,320,069 | 5/1967 | Illingsworth | 96/107 |
| 3,502,471 | 3/1970 | Van Pee et al. | 96/107 |

OTHER PUBLICATIONS

Ulbing, Serial No. 51,021 June 29, 1970, Published in 883 OG 12 on Feb. 2, 1971, No. T883,017.

Journal of Photographic Science, vol. 20, 1972, pp. 107–110.

Journal of Photographic Science, vol. 20, 1972, pp. 223–227.

*Primary Examiner*—Won H. Louie, Jr.

*Attorney, Agent, or Firm*—Alexander, Sell, Steldt & DeLaHunt

[57] ABSTRACT

Silver halide crystals in photographic emulsions are sensitized by the addition of compounds to the emulsion which will form silver sulphide with the silver halide crystals at a fast reaction rate $v$, where $v = k$. [concentration of the sensitizer compound in the emulsion] and $k$, the rate constant for the sulphide formation under the digestion conditions is in the range of from 0.1 to 100 $min^{-1}$, and preferably at 0.5 to 10 $min^{-1}$, provided that the sensitizer compound will distribute itself over the silver halide crystal surfaces at a rate which is fast as compared with the reaction rate of the sensitizer compound with the silver halide crystals so that substantially every silver halide crystal has an amount of sensitizer compound adsorbed to its surface from the beginning of the reaction sufficient to give the emulsion good contrast but not sufficient to cause fog.

17 Claims, No Drawings

PROCESS OF SENSITIZING SILVER HALIDE EMULSIONS WITH HETEROCYCLIC SULFUR COMPOUNDS

This invention relates to the sensitisation of photographic silver halide emulsions.

Photographic silver halide emulsions are prepared by precipitating small crystals or grains of silver halide in the presence of a suitable protective colloid such as gelatin. The resulting grains are extremely fine and are then grown to the required grain size (ripened), the grain size being chosen in dependence upon the final required photographic speed and use of the emulsion.

The resulting ripened emulsion is then treated to increase its sensitivity to a maximum by reaction with compounds which form silver sulphide specks on the surfaces of the silver halide grains. This is known as digestion. Suitable compounds may already be present as impurities in the gelatin or may be deliberately added to the emulsion, e.g., sodium thiosulphate or thiourea. When the maximum sensitisation has been achieved in this way, a further increase can often be obtained by gold sensitisation, e.g., by addition of a small quantity of a complex gold salt such as ammonium aurothiocyanate.

After the required sensitivity has been achieved, the emulsions are usually stabilised by the addition of a suitable stabiliser.

The usual compounds added to the emulsion to form the silver sulphide specks such as sodium thiosulphate or thiourea do not react particularly fast with the silver halide grains and to achieve a sufficiently fast reaction rate and reasonable digestion time one needs to add to the emulsion relatively large amounts of these compounds with the result that some of the compound remains in the finished emulsion deleteriously affecting the storage properties of the emulsion.

When sodium sulphide itself is added to the emulsion to form the silver sulphide specks the formation is difficult to control and high fog and low sensitivity are often given.

We have found according to the present invention that this sensitisation can be achieved relatively quickly by the addition to the emulsion of a sensitiser compound which will form silver sulphide with the silver halide crystals at a fast reaction rate $v$, where $v = k \cdot$ [concentration of the sensitiser compound in the emulsion] and $k$, the rate constant for the sulphide formation under the digestion conditions is in the range of from 0.1 to 100 $min^{-1}$, and preferably of 0.5 to 10 $min^{-1}$, provided that the sensitiser compound will distribute itself over the silver halide crystal surfaces at a rate which is fast (by fast is meant a rate about 10 times or more than the reaction rate) as compared with the reaction rate of the sensitiser compound with the silver halide crystals. As a result there is an even distribution of sensitiser compound over the surfaces of the silver halide crystals at the beginning of the reaction so that substantially all of the silver halide crystals have sufficient sulphur sensitiser to achieve full sensitisation to give the emulsion good contrast while only an insignificant number of grains have sufficient sensitiser to cause fog.

In this way we find that the amount of sensitiser compound can be much less than the amounts of the prior sensitiser compounds e.g., sodium thiosulphate, and only small amounts, if any, of the sensitiser compound need be left at the termination of digestion. Therefore the emulsions prepared according to the invention have better storage properties since there is no or very little sensitiser compound left after digestion to decompose and render the emulsion less stable.

We also find that the time of digestion according to the invention is not as critical as with the prior sensitisers such as sodium thiosulphate. Thus with conventional digestion, the speed rises slowly for the first part of the digestion time and then towards the region of digestion time at which full sensitivity is achieved, the sensitivity increases fairly steeply to a maximum and then starts to decrease, while the fog is initially low and then when the maximum speed is reached, or shortly before this, the fog starts to increase rapidly up to Dmax. The moment for stopping the digestion is therefore extremely critical if good speed and low fog are to be obtained. With digestion according to the invention, however, the speed rapidly reaches from beginning of digestion a high value, sometimes slightly higher than with conventional digestion, and then stays at the higher value, possibly increasing slightly while meanwhile the fog stays at a low value for very long times. The moment for stopping the digestion is therefore not at all critical, which naturally simplifies production. In some cases we have found that the time of digestion can vary from 100 to 500 minutes with very little change in fog or speed.

The sensitisers described in this invention enable the preparation of emulsions with lower red light sensitivity than is obtained in conventionally digested emulsions. This has the advantage that they can withstand red safe-lights for slightly longer periods of time without being light fogged to any substantial extent and so allows one to increase the illumination during processing or preparation. This is also very useful for emulsions which are later to be used to record X-rays. After digestion of the emulsion its spectral response can, however, be extended in the usual way by the addition of suitable optical dye sensitisers which extend the spectral response of emulsion throughout the visible region of the spectrum.

We prefer to use digestion conditions of the order of a pAg of 8.5, a pH of 6.5 and a temperature of 60° C. In practice, however, the digestion conditions can vary widely, for example, at a pAg of from 6 to 9, a pH of from 5.5 to 8, and a temperature of from 25° to 80° C.

The rate constant of the sensitizer compound during digestion can readily be measured in the well known manner, for example as described in "The Rate of Sulphide Formation During Photographic Sulphur Sensitization: Measurement of Proton Evolution" in the Journal of Photographic Science, Vol. 20, 1972 pages 107 to 110.

The rate of distribution of the sensitiser compound over the surfaces of the silver halide crystals is dependent upon how strongly the compound is adsorbed onto the crystals, the more strongly it is adsorbed the slower the rate of distribution. Therefore, for a compound to have a relatively fast rate of distribution it should be relatively weakly adsorbed. It is difficult, although not impossible, to measure this rate of distribution directly because inter alia the compound is reacting at the same time with the silver halide crystals. One can quickly test whether a particular sensitiser compound has a sufficiently fast rate of distribution, however, by testing it in a digestion process and checking the contrast and fog of the resulting digested emulsion. If this is not satisfactory, because of low contrast, high fog or both, i.e. the emulsion could not be used commercially one can assume that the rate of distribution of that compound is not fast enough to ensure that there is uniform distribution of the sensitiser compound over the surfaces of the silver halide crystals of that emulsion at the start of the reaction.

We have found that compounds which include that grouping:

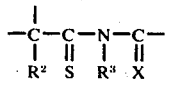

in which $R^2$ and $R^3$ independently represent a hydrogen atom or an alkyl, alkylene, aryl, aralkyl or alkaryl group, and X represents an oxygen or sulfur atom, preferably as part of a heterocyclic ring which is not conjugated or capable of forming aromatic tautomers, all appear to act as sensitizers according to the present invention. Examples of suitable heterocyclic rings (preferably 5 or 6 membered rings) which include this grouping include:

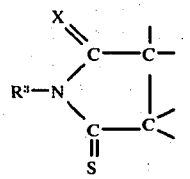

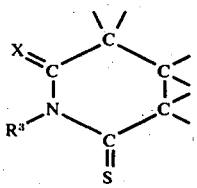

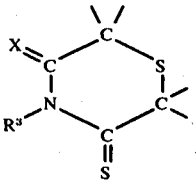

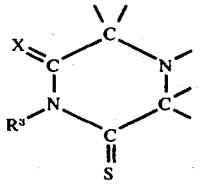

Two general classes of compounds which have this grouping and have been found to be suitable for use as sensitisers according to the present invention have the general formulae:

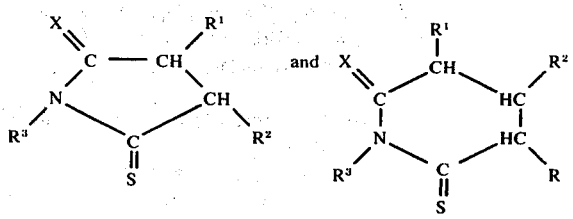

in which R, $R^1$ and $R^2$, which may be the same as one another or different from one another, each represents a hydrogen atom, or an alkyl, alkylene, aryl, aralkyl or alkaryl group, or any two of R, $R^1$ and $R^2$ together represent the atoms required to complete with the atoms to which they are linked an alicyclic, aromatic or heterocyclic ring, and $R^3$ represents a hydrogen atom or an alkyl, alkylene, aryl, aralkyl or alkaryl group, and X represents an oxygen or sulphur atom, or the tautomers of these general formulae.

In these general formulae any alkyl groups represented by R to $R^3$ preferably have up to 4 carbon atoms, while any aryl groups are preferably phenyl groups which may be additionally substituted, e.g., with lower alkyl groups or halogen atoms. The groups represented by R to $R^3$ can contain other atoms besides carbon and hydrogen and can be substituted by substituents which are inert in the photographic emulsion and do not interact strongly with the silver halide crystals and so interfere with the distribution of the sensitiser over the crystals, the sulphide formation or the sulphide speck growth. Thus, for example, these groups should not contain stable thione substituents. Compounds containing more than 1 aryl group are difficult to prepare and so are not preferred.

Compounds not having the required four membered grouping but having only three of the four members are not believed useful in the practice of the present invention. As indicated in an article by D. Cash in "The Journal of Photographic Science", Vol. 20, 1972, entitled "The Rate of Sulphide Formation During Photographic Sulphur Sensitization: Measurement of Proton Evolution", a compound such as rhodanine

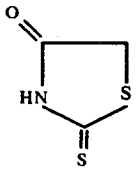

having three of the four required groups, i.e.,

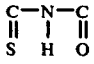

has a rate constant about an order of magnitude below that required in the practice of the present invention.

Compounds of these general classes can be prepared as described in the article "Monothiophthalimide and Some Derivatives of Oxindole" in The Journal of the Chemical Society, 1941, pages 620–1, the article "The Electronic Spectra of Thioamides and Thiohydrazides" in Acta Chemica Scandinavica 20, 1966, pages 889–897, and in United Kingdom Patent Specification No. 746,690, or in analogous manners.

Particular examples of suitable sensitiser compounds for use according to the invention include 1-methyl-2-thiosuccinimide:

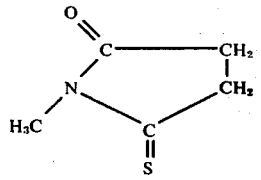

which has a rate constant $k$, under digestion conditions of a pAg of 8.5 , a pH of 6.5 and a temperature of 50° C, of 5 $min^{-1}$, 2-thiosuccinimide:

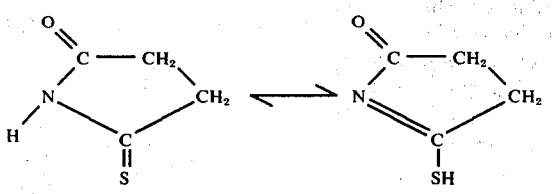

which has a rate constant $k$, under these digestion conditions of 1.5 $min^{-1}$, thiophthalimide:

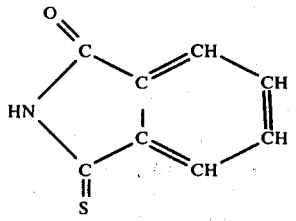

1-phenyl-2-thiosuccinimide, 1-p-anisyl-2-thiosuccinimide, 1-methyl-2,5-dithiosuccinimide, 1-methyl-2-thioglutarimide, 1-phenyl-2-thioglutarimide, 1-methyl-2,6-dithioglutarimide, 1-methyl-2-thio-4-phenylsuccinimide, 2-thio-4-(4-pyridyl) succinimide, 2-thio-3-propenylsuccinimide, 1-tolyl-2-thiosuccinimide, 1-methyl-2-thio-4-benzylsuccinimide, 2-thio-4-vinyl-succinimide, 2-thio-4-(1-allyl)succinimide, cyclohexyl-(1,2-c)-pyrrolidine-2-thione-5-one, piperidino-(2,3-c)-pyrrolidine-2-thione-5-one, pyridoyl-(2,3-c)-pyrrolidine-2-thione-5-one, naphththo-(2,3-c)-pyrrolidine-2-thione-5-one, 2-oxo-4-methyl-6-thioxopiperazine, 2-oxo-6-thioxothiomorpholine, pyrrolidino-(2,3-c)-pyrrolidine-2-thione-5-one.

We prefer to add the sensitiser compounds to the silver halide emulsion for digestion according to the invention in an amount of from 0.5 to 50 micromoles per mole of silver in the emulsion. The sensitiser compounds can be added to the emulsion in solution in a photographically acceptable solvent such as water or ethanol.

In addition to digestion according to the invention one can also add to the emulsion a conventional gold sensitiser, before, during or after the digestion according to the invention.

The type of silver halide emulsion which can be digested according to the invention is not critical. Thus, the emulsion can be a silver chloride, bromide, chlorobromide, or iodobromide. Also the end use to which the emulsion is put is not critical. Thus the invention can be applied to the digestion of emulsions for use on the one hand in microfilms and on the other hand in x-ray detection.

The invention will now be illustrated by the following Examples.

EXAMPLE 1 a bromoiodide polyhedral emulsion of mean grain diameter 1.4 microns was divided into four. One part, emulsion 1, was digested according to the invention after the addition of sufficient of a solution of 1-methyl-2-thiosuccinimide in ethanol to give 3 micromoles of 1-methyl-2-thiosuccinimide per mole of silver bromide. The digestion was effected for 15 minutes at 60° C under conditions of a pAg of 8.5 and a pH of 6.5. The second part, emulsion 2, was digested conventionally with thiosulphate (25 micromoles/mole of silver bromide) for 45 minutes under similar digestion conditions to emulsion 1. The third and fourth parts, emulsions 3 and 4 respectively, were digested in similar ways to emulsions 1 and 2, respectively, except that, prior to digestion an aqueous solution of sodium auric chloride (2.5 micromoles auric chloride/mole of silver bromide) was added to each and then the resulting emulsions 3 and 4 were digested for 35 minutes and 60 minutes, respectively.

Thereafter all four emulsions were finished and coated onto suitable polyester backings. The photographic properties of the resulting emulsions as initially prepared and after advanced aging for 7 days at 50° C and a relative humidity of 60%, C, and for 14 days at 50° C and a relative humidity of 60% are given in the following Table I, emulsion 2 being taken as a standard.

TABLE I

| | | Initial Properties | | After 7 days | | After 14 days | |
|---|---|---|---|---|---|---|---|
| Emulsion | Relative red Sensitivity (red light) | Fog | Relative Sensitivity (blue light) | Fog | Relative Sensitivity (blue light) | Fog | Relative Sensitivity (blue light) |
| 1 | −0.21 | 0.04 | 1.26 | 0.05 | 1.06 | 0.14 | 0.91 |
| 2 (Standard) | 0 | 0.05 | 1.19 | 0.25 | 0.86 | 0.42 | 0.66 |
| 3 | 0.01 | 0.12 | 1.65 | 0.12 | 1.50 | 0.21 | 1.30 |
| 4 | 0.23 | 0.12 | 1.61 | 0.27 | 1.44 | 0.47 | 1.12 |

As can be seen from these results emulsion 1 according to the invention had a much lower red sensitivity than emulsion 2 and so could be handled during preparation or processing more easily under red safe lights. It can also be seen that the relative red sensitivity of emulsion 3 is only slightly increased as compared with the standard emulsion 2 whereas its blue light sensitivity was increased by 0.46. It will further be noted that the digestion time was much shorter for emulsion 1 than for emulsion 2 and the amount of sensitiser added was much less. Therefore emulsion 1 had much better storage properties as can be seen from the advanced aging results, both as regards fog and retention of photographic speed. In practice the fog of emulsion 2 after 14 days advanced aging would have been too high for it to be useful commercially.

It can be seen that similar advantages were given for emulsion 3 as compared with emulsion 4 where additionally the emulsions were sensitised with gold compound.

EXAMPLE 2

A polyhedral bromoiodide photographic emulsion of mean grain diameter 1.47 microns and containing 1 mole of silver halide in 725 g was adjusted to pH 6.8, and pAg 8.5 at 55° C. A 1 millimolar solution of one of the sensitisers given in the following Table II in ethanol was added dropwise in an amount also shown in Table II to the stirred emulsion. After 1 minute 12 ml of a 0.15 millimolar gold chloride solution containing a 133 fold mold excess of potassium thiocyanate was added. The emulsion was then digested for the time shown in the following Table II at 55° C and the digestion was terminated by addition of a solution containing stabiliser and antifoggant in the normal way.

The resulting emulsion was coated onto polyester film and some of its photographic properties measured. The results are also recorded in the following Table II.

TABLE II

| Sensitiser | Quantity of solution added (micromoles) | Digestion time (min) | Relative log sensitivity | Fog |
|---|---|---|---|---|
| 1-methyl-2-thiosuccinimide | 3 | 23 | 1.6 | 0.12 |
| 2-thiosuccinimide | 3 | 28 | 1.6 | 0.12 |
| thiophthalimide | 3 | 23 | 1.6 | 0.12 |

EXAMPLE 3

To 1 mole of fine-grain silver iodobromide emulsion of an average grain size of 0.21 micron was added 40 micromoles of gold chloride followed by 40 micromoles of 1-methyl-2-thiosuccinimide. This was digested to optimum and its photographic properties compared with another sample of the same emulsion which had sensitised conventionally by adding sodium thiosulphate and gold chloride. The results are given in the following Table III.

TABLE III

| Sensitiser | Base & Fog | Relative log sensitivity | Average contrast | D max |
|---|---|---|---|---|
| 1-methyl-2-thiosuccinimide | 0.05 | 1.10 | 2.00 | 2.73 |
| sodium thiosulphate | 0.05 | 1.00 | 1.90 | 2.73 |

EXAMPLE 4

In order to demonstrate the progress of digestion of a photographic emulsion according to the invention the following digestion was performed.

To a fine-grain silver iodobromide emulsion of an average grain size of 0.21 micron was added 40 micromoles of gold chloride and 60 micromoles of 1-methyl-2-thiosuccinimide. Digestion was effected at a pH of 6.0, a pAg of 8.5 and a temperature of 55° C and the photographic properties tested periodically. The results are given in the following Table IV.

TABLE IV

| Digestion time (minutes) | Fog | Relative log sensitivity | Average contrast | D max |
|---|---|---|---|---|
| 15 | 0.02 | 2.03 | 2.07 | 3.15 |
| 35 | 0.02 | 2.13 | 2.11 | 3.04 |
| 65 | 0.02 | 2.15 | 2.17 | 3.07 |
| 115 | 0.02 | 2.17 | 2.15 | 3.06 |
| 215 | 0.03 | 2.21 | 2.16 | 3.03 |

As can be seen from these results, the fog only increased marginally with time while the speed rapidly reached an almost constant value. Thus, between 35 and 115 minutes there was no noticible increase in fog and a very slight increase in speed. As a result the time of digestion within this wide period was not critical. In a conventional digestion, say with sodium thiosulphate, the digestion time is very critical to obtain good results, for example one may have a latitude of only 5 minutes in the choice of digestion time, in order to obtain a relatively high speed and relatively low fog. This effect is clearly illustrated in the following Example which gives a comparison of the progress of a digestion according to the invention using 1-methyl-2-thiosuccinimide and a conventional digestion using sodium thiosulphate.

EXAMPLE 5

A fine grain iodobromide emulsion containing 3% iodide was adjusted to a pH of 6.0, a pAg of 8.5 and divided into two portions. To one portion 200 micromoles of sodium thiosulphate per mole of silver halide was added and 40 micromoles of sodium aurichloride in aqueous solution per mole of silver halide. To the other portion 60 micromoles of 1-methyl-2-thiosuccinimide per mole of silver halide and 40 of sodium aurichloride per mole of silver halide were added. The digestion of the two emulsions was then followed by a continuous monitoring technique involving continuous withdrawal of emulsion and development with and without exposure, the resulting optical density before exposure being a measure of fog and after exposure being a measure of sensitivity.

The results are shown in the accompanying graph in which line A is the relative fog and line B the relative sensitivity for the emulsion digested with sodium thiosulphate, and line C is the relative fog and line D the relative sensitivity for the emulsion digested according to the invention with 1-methyl-2-thiosuccinimide.

EXAMPLE 6

A polyhedral iodobromide photoemulsion containing 1.8 mole % iodide with a narrow grain size distribution with a maximum at 1.45 microns diameter in inert gelatin was adjusted to a pH of 6.8 and a pAg of 8.5. It was heated to 60° C and 3 micromoles of 1-phenyl-2-thiosuccinimide in ethanol per mole of silver halide was added. The emulsion was allowed to digest for 8 minutes at 60° C and its fog and relative sensitivity measured at 0.2 O.D. above fog. The fog was 0.05 while the relative sensitivity was 2.50 as compared with a relative sensitivity of 1.6 at the start of the digestion.

EXAMPLE 7

A fine grain octahedral low contrast silver bromoiodide photoemulsion with a larger than normal iodide content (3.6 mole % iodide) and a grain size distribution between 0.3 and 2 microns with a maximum around 1 micron made with inert gelatin and suitable for amateur negative black and white photography was divided into four parts. Each portion was adjusted to a pH of 5.8, a pAg of 8.8 and contained 1 mole of silver per 1333 g total weight. Each portion was then heated to 55° C. To one portion no addition was made, to a second portion 25 micromoles of sodium thiosulphate in aqueous solution per mole of silver halide was added, and to the third and fourth portions 7 and 10 micromoles of 1-methyl--thiosuccinimide in absolute ethanol per mole of silver halide were respectively added. After two minutes 3.8 micromoles of sodium aurichloride in aqueous solution per mole of silver halide was added to each portion. The developement of sensitivity and fog during digestion was followed by taking samples and the results are shown in the following Table V.

As can be seen from the results, in the case of 1-methyl-2-thiosuccinimide the sensitivity rises sooner and is retained for a longer period than with sodium thiosulphate, thus making the time for terminating the digestion less critical.

TABLE V

| | No Addition | | Sodium Thiosulphate | | 1-Methyl-2-thiosuccinimide (7 micromoles) | | 1-Methyl-2-thiosuccinimide (10 micromoles) | |
|---|---|---|---|---|---|---|---|---|
| Digestion Time (min) | Rel log sensitivity | Base + Fog(O.D.) | Rel log sensitivity | Base + Fog(O.D.) | Rel log sensitivity | Base + Fog(O.D.) | Rel log sensitivity | Base + Fog(O.D.) |
| 10 | 1.4 | 0.1 | 1.9 | 0.10 | 2.4 | 0.10 | 2.6 | 0.10 |
| 20 | 1.4 | 0.1 | 2.1 | 0.10 | 2.8 | 0.10 | 2.8 | 0.10 |
| 40 | 1.4 | 0.1 | 2.3 | 0.10 | 2.9 | 0.10 | 2.9 | 0.10 |
| 80 | 1.4 | 0.1 | 2.6 | 0.10 | 2.9 | 0.10 | 2.9 | 0.10 |
| 120 | 1.4 | 0.1 | 2.8 | 0.10 | 2.9 | 0.10 | 2.9 | 0.10 |
| 200 | 1.4 | 0.1 | 2.9 | 0.10 | 2.9 | 0.10 | 2.9 | 0.10 |
| 350 | 1.4 | 0.1 | 2.9 | 0.18 | 2.9 | 0.10 | 2.9 | 0.10 |
| 500 | 1.4 | 0.1 | 2.7 | 0.23 | 2.7 | 0.10 | 2.7 | 0.12 |
| 700 | 1.4 | 0.1 | 2.4 | 0.54 | 2.6 | 0.12 | 2.6 | 0.16 |

EXAMPLE 8

A polyhedral iodobromide photoemulsion containing 1.8 mole % iodide with a narrow grain size distribution and a maximum at 1.45 microns diameter in inert gelatin was adjusted to a pH of 6.8 and a pAg of 8.5. It was heated to 60° C and 3 micromoles of 1-p anisyl-2-thiosuccinimide in ethanol per mole of silver halide were added. The emulsion was allowed to digest for 8 minutes at 60° C and its fog and relative log sensitivity measured at 0.2 O.D. above fog. The fog was 0.05 while the relative log sensitivity was 2.54 as compared with a relative log sensitivity of 1.6 at the start of the digestion.

I claim:

1. A process for sensitizing a photographic silver halide emulsion comprises digesting the silver halide emulsion in contact with a sensitizing amount of a sensitiser whereby said sensitiser compound forms on the silver halide crystals the silver sulphide at a reaction rate $v$, where $v = k \cdot$[concentration of the sensitizer compound in the emulsion] and $k$, the rate constant for the sulphide formation under the digestion conditions, is in the range of from 0.1 to 100 $min^{-1}$, the sensitiser compound being capable of distributing itself over the silver halide crystal surfaces at a rate which is fast as compared with the reaction rate of the sensitiser compound and the silver halide crystals, in which the sensitiser compound is a compound which includes as part of a 5-, or 6-membered heterocyclic ring in the grouping:

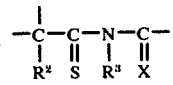

in which $R^2$ and $R^3$ represents a hydrogen atom or an alkyl, alkylene, aryl, aralkyl or alkaryl group, and X represents an oxygen or sulphur atom.

2. A process as claimed in claim 1 in which $k$ is from 0.5 to 10 $min^{-1}$.

3. A process as claimed in claim 1 in which the digestion is effected at a pAg of from 6 to 9, a pH of from 5.5 to 8, and a temperature of from 25° to 80° C.

4. A process as claimed in claim 3 in which the digestion is effected at a pAg of about 8.5, a pH of about 6.5 and a temperature of about 60° C.

5. A process as claimed in claim 1 in which the sensitiser compound is one having the general formula:

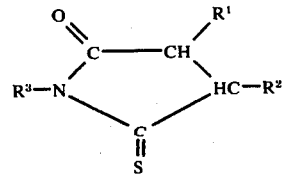

in which $R^1$ and $R^2$, which may be the same as one another or different from one another, each represents a hydrogen atom, or an alkyl, alkylene, aryl, aralkyl or alkaryl group, or $R^1$ and $R^2$ together represent the atoms required to complete with the atoms to which they are linked an alicyclic, aromatic or heterocyclic ring, and $R^3$ represents a hydrogen atom or an alkyl, alkylene, aryl, aralkyl or alkaryl group, or a tautomer of such a compound.

6. A process as claimed in claim 1 in which the sensitiser compound is one having the general formula:

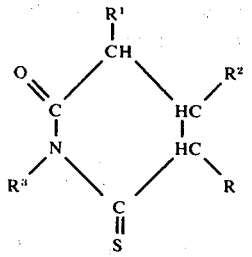

in which R, $R^1$ and $R^2$, which may be the same as one another or different from one another, each represents a hydrogen atom, or an alkyl, alkylene, aryl, aralkyl or alkaryl group, or any two of R, $R^1$ and $R^2$ together represent the atoms required to complete with the atoms which they are linked an alicyclic, aromatic or heterocyclic ring, and $R^3$ represents a hydrogen atom or an alkyl, alkylene, aryl, aralkyl or alkaryl group, or a tautomer of such a compound.

7. A process as claimed in claim 1 in which the sensitizer compound is one having the general formula:

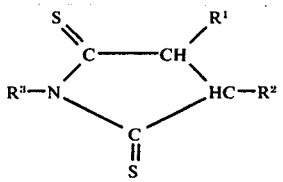

in which $R^1$ and $R^2$, which may be the same as one another or different from one another, each represents a hydrogen atom, or an alkyl, alkylene, aryl, aralkyl or alkaryl group, or $R^1$ and $R^2$ together represent the atoms required to complete with the atoms to which they are linked an alicyclic, aromatic or heterocyclic ring, and $R^3$ represents a hydrogen atom or an alkyl, alkylene, aryl, aralkyl or alkaryl group, or a tautomer of such a compound.

8. A process as claimed in claim 1 in which the sensitiser compound is one having the general formula:

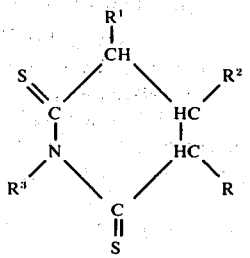

in which R, $R^1$ and $R^2$, which may be the same as one another or different from one another, each represents a hydrogen atom, or an alkyl, alkylene, aralkyl or alkaryl group, or any two of R, $R^1$ and $R^2$ together represent the atoms required to complete with the atoms to which they are linked an alicyclic, aromatic or heterocyclic ring, and $R^3$ represents a hydrogen atom or an alkyl, alkylene, aryl, aralkyl or alkaryl group, or a tautomer of such a compound.

9. A process as claimed in claim 1 in which the sensitiser compound is 1-methyl-2-thiosuccinimide.

10. A process as claimed in claim 1 in which the sensitiser compound is 2-thiosuccinimide.

11. A process as claimed in claim 1 in which the sensitiser compound is thiophthalimide.

12. A process as claimed in claim 1 in which the sensitiser compound is 1-phenyl-2-thiosuccinimide.

13. A process as claimed in claim 1 in which the sensitiser compound is 1-p-anisyl-2-thiosuccinimide.

14. A process as claimed in claim 1 in which the sensitiser compound is added to the emulsion in an amount of from 0.5 to 50 micromoles per mole of silver in the emulsion.

15. A process for sensitizing a photographic silver halide emulsion comprises digesting the silver halide emulsion in contact with a sensitizing amount of a sensitiser whereby said sensitiser compound forms on the silver halide crystals the silve sulphide at a reaction rate $v$, where $v = k$ [concentration of the sensitizer compound in the emulsion] and $k$, the rate constant for the suplhide formation under digestion conditions of pAg 6 to 9, pH of 5.5 to 8 and temperature of 25° to 80° C, is in the range of from 0.1 to 100 $min^{-1}$, the sensitiser compound being capable of distributing itself over the silver halide crystal surfaces at a rate which is fast as compared with the reaction rate of the sensitiser compound and the silver halide crystals in which said sensitiser compound has as part of a 5- or 6-membered heterocyclic ring the grouping:

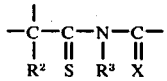

in which $R^2$ and $R^3$ represents a hydrogen atom or an alkyl, alkylene, aryl, aralkyl or alkaryl group, and X represents an oxygen or sulphur atom, the heterocyclic ring being neither conjugated nor capable of forming an aromatic tautomer.

16. The silver halide emulsion resulting from the process of claim 1.

17. The silver halide emulsion resulting from the process of claim 15.

* * * * *

UNITED STATES PATENT AND TRADEMARK OFFICE

CERTIFICATE OF CORRECTION

PATENT NO. : 4,001,025

DATED : January 4, 1977

INVENTOR(S) : Derek J. Cash

It is certified that error appears in the above-identified patent and that said Letters Patent are hereby corrected as shown below:

Col. 8, line 41, "40 of" should be --40 micromoles of--.

Claim 1, col. 10, line 4, "ring in the grouping" should be --ring the grouping--.

Claim 6, col. 11, line 26, "atoms which they" should be --atoms to which they--.

Claim 15, col. 12, line 42, "v = k" should be --v = k·--.

Signed and Sealed this

First Day of November 1977

[SEAL]

*Attest:*

RUTH C. MASON
*Attesting Officer*

LUTRELLE F. PARKER
*Acting Commissioner of Patents and Trademarks*